US005566811A

United States Patent [19]

Draghetti et al.

[11] Patent Number: 5,566,811

[45] Date of Patent: Oct. 22, 1996

[54] METHOD AND MACHINE FOR PRODUCING FILTER-TIPPED CIGARETTES

[75] Inventors: Fiorenzo Draghetti, Medicina; Salvatore Rizzoli, Bologna, both of Italy

[73] Assignee: G.D Societa' Per Azioni, Bologna, Italy

[21] Appl. No.: 248,619

[22] Filed: May 25, 1994

[30] Foreign Application Priority Data

May 31, 1993 [IT] Italy ..... BO93A0244
Apr. 7, 1994 [IT] Italy ..... BO94A0147

[51] Int. Cl.[6] ..... B65G 47/24

[52] U.S. Cl. ..... 198/399; 198/951

[58] Field of Search ..... 198/399, 951

[56] References Cited

U.S. PATENT DOCUMENTS

| | | | |
|---|---|---|---|
| 2,988,198 | 6/1961 | Pinkham | 198/32 |
| 3,245,514 | 4/1966 | Herrmann | 198/399 |
| 3,973,671 | 8/1976 | Schwenke | 198/248 |
| 4,630,724 | 12/1986 | Horie et al. | 198/399 |
| 4,823,932 | 4/1989 | Hinz | 198/450 |
| 5,135,008 | 8/1992 | Oesterling et al. | 131/94 |

FOREIGN PATENT DOCUMENTS

| | | | |
|---|---|---|---|
| 0580150 | 1/1994 | European Pat. Off. . | |
| 1532099 | 1/1970 | Germany | 198/399 |
| 1007893 | 10/1965 | United Kingdom | 198/951 |
| 2241866 | 9/1991 | United Kingdom . | |

*Primary Examiner*—D. Glenn Dayoan
*Attorney, Agent, or Firm*—Marshall, O'Toole, Gerstein, Murray & Borun

[57] ABSTRACT

On a cigarette filter assembly machine, (2), a first and second succession of side by side, oppositely-oriented filter-tipped cigarettes are fed to a turnover unit settable to two distinct operating positions for turning over by 180° the cigarettes in one or other of the two successions; the overturned cigarettes being transferred onto the opposite side of the cigarettes in the other succession to form two successions of equioriented, transversely-spaced cigarettes.

13 Claims, 4 Drawing Sheets

METHOD AND MACHINE FOR PRODUCING FILTER-TIPPED CIGARETTES

BACKGROUND OF THE INVENTION

The present invention relates to a method of producing filter-tipped cigarettes.

As described, for example, in British Patent no. 2,241,866, filter-tipped cigarettes are formed on a filter assembly machine, along a first portion of which each portion in a first succession of cigarette portions with a given spacing is joined, at a rolling station and by means of a strip connecting element, to a corresponding portion in a second succession of cigarette portions, to form a tobacco item hereinafter referred to as a "double cigarette". Each double cigarette consists of two cigarette portions separated by a double filter connected integral with the two cigarette portions by said connecting element, the central portion of which surrounds the double filter, and each end portion of which surrounds the end of a respective cigarette portion.

Again according to the above British patent, once formed, the double cigarettes are fed successively through a cutting station where they are cut transversely in half to form two successions of oppositely-oriented single cigarettes. That is, downstream from the cutting station, the cigarettes in each pair of cigarettes formed by cutting a respective double cigarette are arranged with the respective filters facing and substantially contacting each other.

According to the above British patent, the two successions of filter-tipped cigarettes are then fed to a turnover station Where each cigarette in one succession is turned over and fed into the space between two adjacent cigarettes in the other succession, to form a single succession of equioriented cigarettes, which are then fed to the output of the filter assembly machine and from there to the input of a packing machine.

It has recently been found necessary to connect the filter assembly machine to a packing assembly consisting of a double packing machine, i.e. with two packing lines, or of a pair of individual packing machines. In other words, the problem has arisen of connecting the filter assembly machine to a packing assembly presenting two inputs a given distance apart.

One possible solution would be to employ a two-line filter assembly machine of the type described in British Patent no. 2,201,576 and no. 2,202,127, but without the turnover station at the output, which forms the two lines into one. This, however, obviously poses the problem of devising a packing assembly with two inputs capable of receiving respective successions of oppositely-oriented cigarettes.

Recently, the above problem has been solved using a filter assembly machine whereby, as described in Italian Patent Application no. BO92A000311, two successions of oppositely-oriented cigarettes are fed to a turnover station where the cigarettes in one succession are turned over outwards by 180° in relation to those in the other succession, to form two successions of equioriented, transversely-spaced cigarettes. On the above machine, the cigarettes in the first succession are turned over by means of a turnover unit comprising, for each cigarette, a respective turnover member for receiving and retaining a respective cigarette; and a drive unit common to all the turnover members and which provides for rotating each turnover member 180° about its axis.

Though they do in fact provide for successfully supplying a packing assembly featuring two inputs a given distance apart, a major drawback of known filter assembly machines of the above type is the relatively high cost involved, mainly due to the large number of components and relatively complex design of the turnover unit.

SUMMARY OF THE INVENTION

It is an object of the present invention to provide a method of simultaneously feeding two successions of equioriented cigarettes to two spaced inputs of a packing assembly, and which at the same time provides for overcoming the aforementioned drawback.

According to the present invention, there is provided a method of producing filter-tipped cigarettes, the method comprising stages consisting in feeding two side by side successions of oppositely-oriented filter-tipped cigarettes; and turning over the cigarettes in a first of the two successions so that they are oriented the same way as the cigarettes in a second of the two successions; characterized in that said turnover stage provides for transferring each cigarette in the first succession from a first position in relation to the cigarettes in the second succession, to a second position on the opposite side of the cigarettes in the second succession as compared with the first position and a given distance from the cigarettes in the second succession; said transfer involving turning each cigarette in the first succession over by 180°, to form two successions of equioriented, transversely-spaced cigarettes.

According to a preferred embodiment of the above method, the two successions of equioriented cigarettes are fed along respective separate paths to respective outputs of the filter assembly machine.

The present invention also relates to a machine for producing filter-tipped cigarettes.

According to the present invention, there is provided a machine for producing filter-tipped cigarettes, the machine comprising first feeding means for feeding two side by side successions of oppositely-oriented filter-tipped cigarettes; turnover means for turning over the cigarettes in a first of the two successions so that they are oriented the same way as the cigarettes in a second of the two successions; and second feeding means for feeding said two successions of equioriented cigarettes; characterized in that said turnover means comprise transfer means for transferring each cigarette in the first succession, by turning it over by 180°, from a first position in relation to the cigarettes in the second succession, to a second position on the opposite side of the cigarettes in the second succession as compared with the first position and a given distance from the cigarettes in the second succession, to form two successions of equioriented, transversely-spaced cigarettes.

Said turnover means preferably also comprise a first and second roller with a common axis; the first roller being substantially twice as long as the second roller, and presenting seats for each receiving two oppositely-oriented cigarettes substantially contacting each other; and the second roller being located said given distance from the first roller, presenting seats for each receiving a respective cigarette, and being connected to the first roller by said transfer means.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
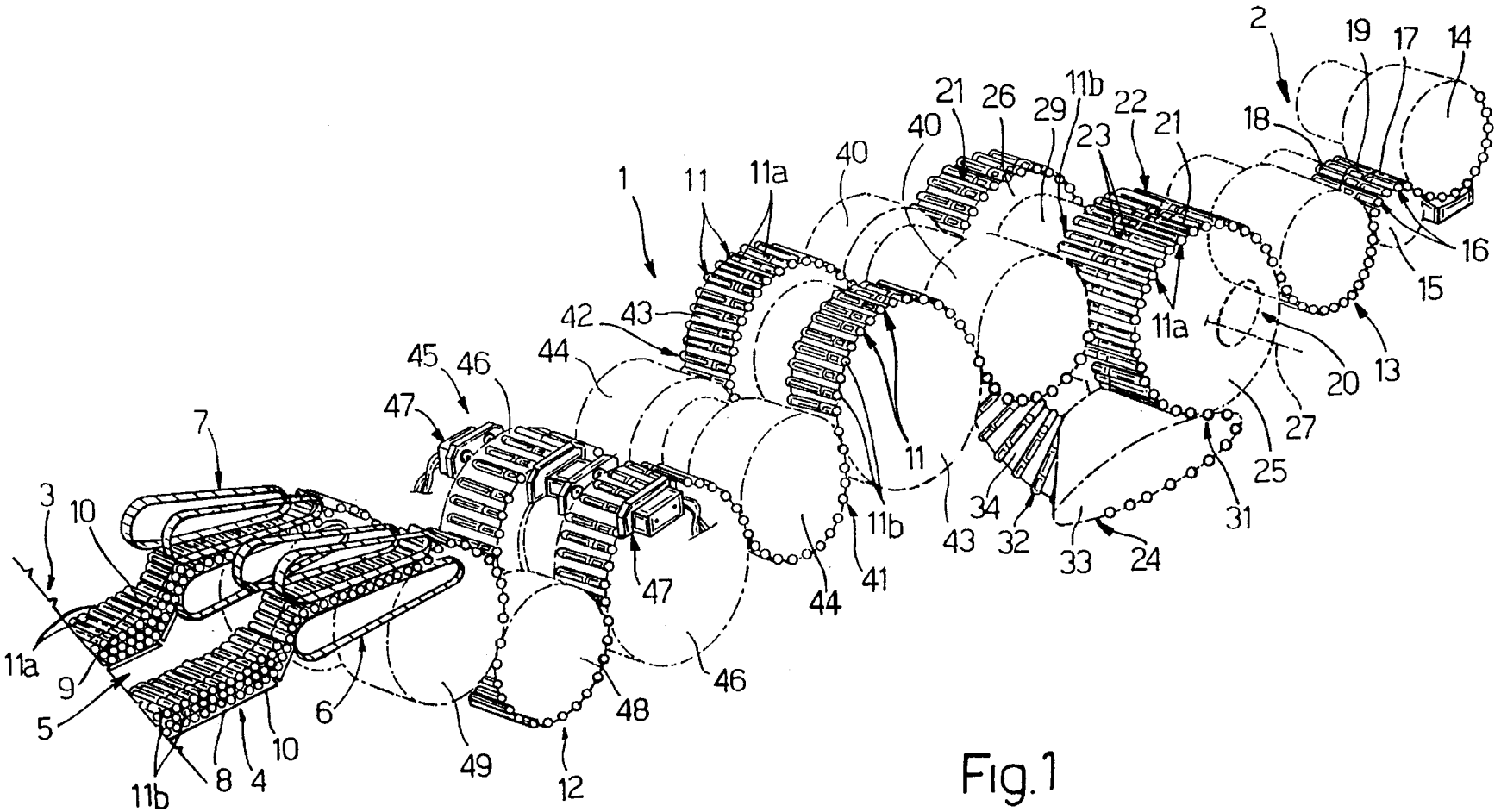
FIG. 1 shows a schematic view in perspective, with parts removed for clarity, of a first preferred embodiment of a machine in accordance with the present invention.

Number 1 in FIG. 1 indicates a system for producing tobacco items and comprising a filter assembly machine 2; and a packing assembly 3 presenting two parallel packing lines 4 and 5 with respective known input feed devices 6 and 7 spaced transversely in relation to lines 4 and 5.

In known manner, lines 4 and 5 comprise respective channels 8 and 9 connected respectively to devices 6 and 7, for feeding respective masses 10 of filter-tipped cigarettes 11 to respective feedboxes (not shown) supplying respective known conveyors (not shown).

Again with reference to FIG. 1, filter assembly machine 2 presents an output portion 12 supported on a single fixed frame (not shown), and comprising a first roller 13 to which is fed, by means of two transfer rollers 14 and 15, a succession of double cigarettes 16, each comprising two cigarette portions 17 and 18 connected by a double filter 19. Double cigarettes 16 are fed by roller 13, rotating clockwise in FIG. 1, through a known cutting station 20 where they are cut in half to form two successions 21 and 22 of cigarettes 11, respectively indicated 11a and 11b, arranged side by side and oppositely oriented, i.e. with their filters 23 facing and substantially contacting each other.

Figure 2:
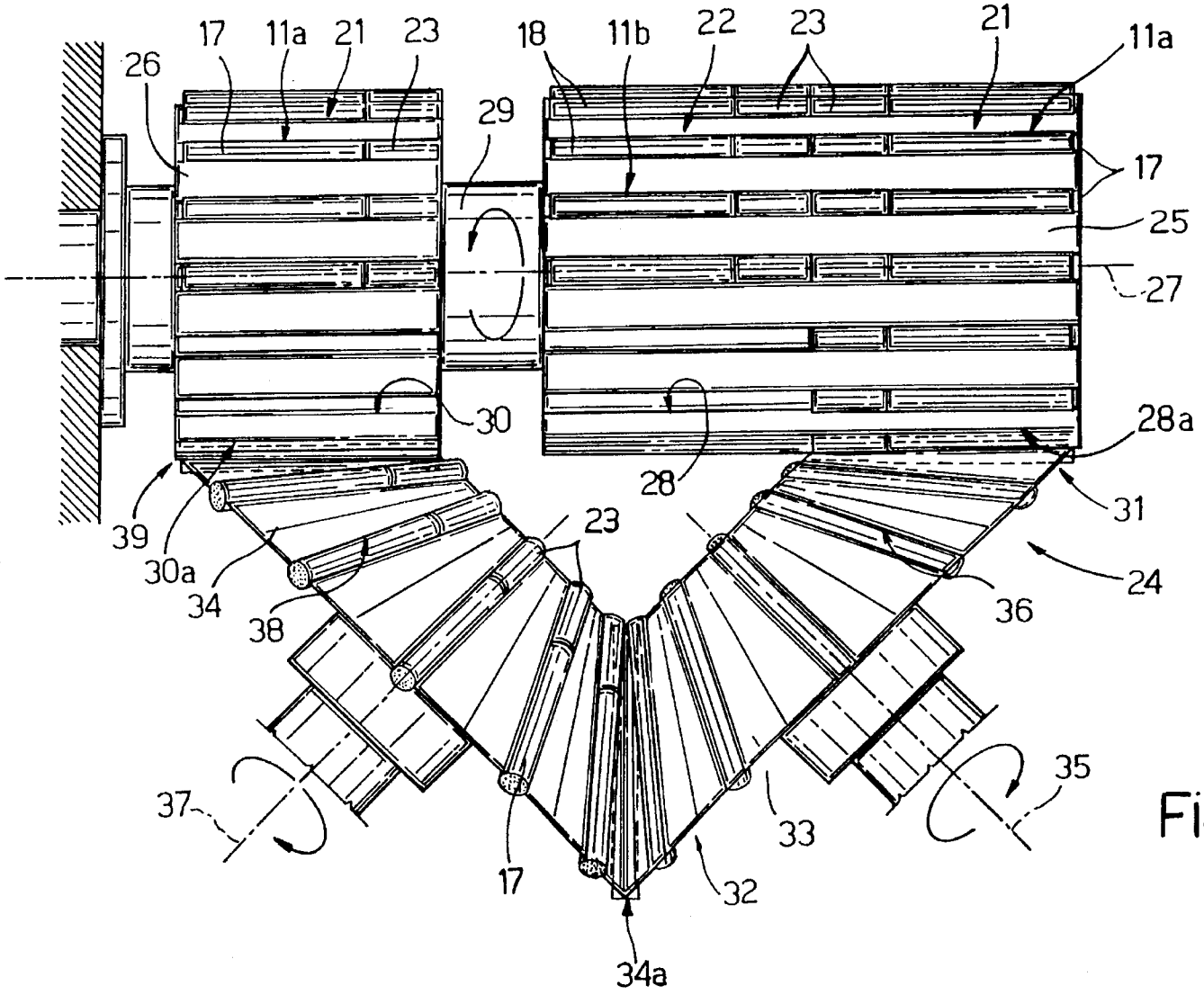
FIG. 2 shows a larger-scale side view of a detail of the FIG. 1 machine.

Successions 21 and 22 are transferred from roller 13 to a turnover unit 24 comprising two side by side rollers 25 and 26. Roller 25 is tangent to roller 13; is substantially twice as long as roller 26; rotates anticlockwise in FIG. 1 about its axis 27 (FIG. 2); and presents a number of equally spaced peripheral suction seats 28 for each receiving and retaining a respective cigarette 11a and a respective cigarette 11b arranged facing, contacting, and oppositely oriented in relation to each other.

Roller 26 is connected integral and coaxially with roller 25, on the same side as succession 22, by a shaft 29 of given length, and presents a number of peripheral suction seats 30 (FIG. 2), each extending in line and coaxially with a corresponding seat 28, and each designed to receive and retain a respective filter-tipped cigarette 11*a* parallel to and coaxial with a corresponding cigarette 11*b* housed in corresponding seat 28. As they travel about roller 25, cigarettes 11a in succession 21 are fed to a pickup station 31 where, by means of a turnover assembly 32 with conical rollers and forming part of unit 24, they are withdrawn successively and turned over by 180° into seats 30 on roller 26. Each cigarette 11*a* in succession 21 housed inside a respective seat 28 is thus turned over onto the opposite side of succession 22 and positioned in line with and facing the same way as a corresponding cigarette 11*b*.

In the example shown, assembly 32 comprises two conical rollers 33 and 34 with perpendicular axes coplanar with each other and with axis 27. Roller 33 rotates clockwise in FIG. 2 about its axis 35, and is tangent to roller 25 at station 31 where the contacting generating lines of rollers 25 and 33 are parallel to axis 27 and lie in a vertical plane parallel to the FIG. 2 plane and containing axes 27 and 35. Roller 33 provides for withdrawing a respective cigarette 11*a* from a loading seat 28*a* in station 31, and presents a number of peripheral suction seats 36 parallel to the generating lines of roller 33, and each designed to receive and retain a respective cigarette 11a.

Roller 34 rotates about an axis 37 perpendicular to axis 35 and lying in said vertical plane containing axes 27 and 35, and also presents a number of peripheral suction seats 38 parallel to the generating lines of roller 34, and each designed to receive and retain a respective cigarette 11a. Roller 34 is tangent to roller 33 at a transfer station 34*a* where the contacting generating lines of rollers 33 and 34 are perpendicular to axis 27 and coplanar with said vertical plane containing axes 27, 35. Roller 34 is also tangent to roller 26 at an unloading station 39 where the contacting generating lines of rollers 34 and 26 are aligned with the contacting generating lines of rollers 25 and 33 in station 31, and also lie in said vertical plane containing axes 27, 35 and 37. At station 39, roller 34 provides for feeding a respective cigarette 11*a* into an unloading seat 30*a* on roller 26, coaxial with seat 28*a* in station 39.

On leaving unit 24, successions 21 and 22 are transferred from rollers 25 and 26 to respective rollers 40 arranged side by side and integral with each other, separated by a distance equal to the length of shaft 29, respectively tangent to rollers 25 and 26, and constituting the input rollers of respective lines 41 and 42 for feeding respective successions 22 and 21 to input devices 6 and 7 of lines 4 and 5 of assembly 3.

Each line 41, 42 comprises two conveyor rollers 43 and 44 tangent to each other, and of which roller 43 is also tangent to a respective roller 40. Each line 41, 42 also comprises, in known manner, a known test unit 45 in turn comprising a roller 46 tangent to respective roller 44 and which provides for feeding respective cigarettes 11 to known test devices 47 for successively testing the permeability and/or integrity and/or ventilation of cigarettes 11 and, if necessary, rejecting them at a known reject station (not shown) along the periphery of a roller 48 tangent to roller 46 and interposed between roller 46 and an output roller 49 cooperating with a respective input device 6, 7.

In connection with the above, it should be pointed out that, even if machine 2 were to present a single output, and successions 21 and 22 were to be brought together transversely to form a single succession of equioriented cigarettes for supply to said single output, the axial spacing effected by turnover unit 24 would still be required due to the presence of test unit 45 in which successions 21 and 22 must be spaced a given distance apart to permit insertion of devices 47.

In actual use, on leaving cutting station 20, cigarettes 11 are transferred to roller 25 and fed into seats 28 in the original position, i.e. oppositely-oriented and coaxial, with filters 23 substantially contacting each other. As it rotates, roller 25 transfers cigarettes 11*b* in succession 22 directly onto respective roller 40, whereas cigarettes 11*a* in succession 21 are fed by roller 25 to station 31 where they are withdrawn successively from respective seats 28 by turnover assembly 32, and turned over, by 180° in relation to the original position, into seats 30 on roller 26. Roller 26 in turn transfers cigarettes 11*a* in succession 21 to respective roller 40, from which point on, the equioriented cigarettes 11 in both successions 21 and 22 proceed towards input devices 6 and 7 of assembly 3.

Successions 21 and 22 of equioriented cigarettes 11 are thus formed in an extremely straightforward manner, as of a known filter assembly machine 2, and using a turnover unit 24 whereby the cigarettes 11 in one of successions 21, 22, in this case succession 22, are fed, with no manipulation whatsoever, along a given path; while the cigarettes 11 in the other succession, in this case succession 21, are turned over by 180° and spaced in relation to cigarettes 11 in succession 22 by feeding them along a semi-annular path defined by conical-roller turnover assembly 32. Moreover, by virtue of simply comprising two conical rollers, turnover assembly 32 is in itself extremely straightforward to produce and, hence, highly reliable, while at the same time providing for both equiorienting and axially spacing the cigarettes.

In connection with the spacing of successions 21 and 22, it should be pointed out that the amount of spacing, which in the example shown is relatively small, may be adjusted as required within a given range by varying the size of rollers 33, 34 and, obviously, the distance between rollers 25 and 26 by varying the length of shaft 29 connecting the two rollers.

A further point to note in connection with the spacing of successions 21 and 22 is that the amount of spacing imparted by unit 24 is of no great importance in that, assuming it is other than zero, it may easily be adjusted by means of straightforward known guide devices (not shown) comprising guide channels or wedges connected, for example, to rollers 48 or 49, for selectively sliding cigarettes 11 axially and so positioning successions 21 and 22 as to accurately engage input devices 6 and 7 of assembly 3.

A further point to note is that, as a consequence of succession 21 being turned over by 180° by turnover unit 24, the cigarettes at the output of machine 2 are oriented with the filter in view, i.e. with the filter facing the operator in front of machine 2.

Conversely, if cigarettes 11*b* in succession 22 were to be turned over, as opposed to cigarettes 11*a* in succession 21, the cigarettes at the output of machine 2 would obviously all be oriented with the tobacco in view. To enable selection of the final orientation of the cigarettes at the output, machine 2 may be modified as shown in FIGS. 3 and 4 which relate to a machine 51 enabling the final orientation of the cigarettes to be selected, and the corresponding component parts of which are indicated, wherever possible, using the same numbering system as for machine 2.

Figure 3:
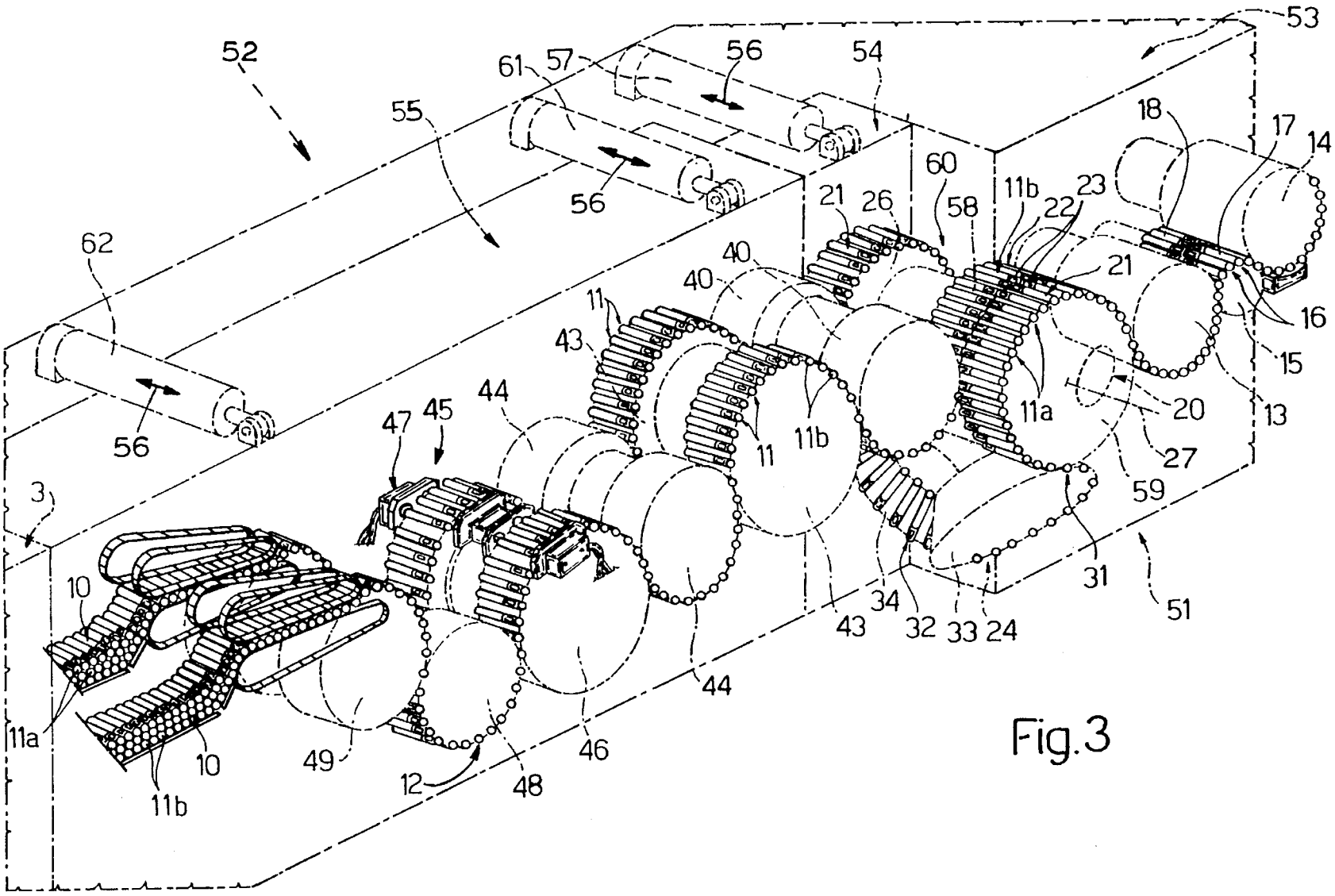
FIG. 3 shows a schematic view in perspective, with parts removed for clarity, of a second preferred embodiment of a machine in accordance with the present invention.

As shown in FIG. 3, machine 51 comprises a frame 52 consisting of three portions 53, 54, 55 movable in relation to one another, unlike machine 2 wherein output portion 12 is supported, as stated, on a single fixed frame (not shown). More specifically, portion 53 is fixed and extends along the whole of machine 51, while the other two portions are fitted to portion 53 and movable in relation to it in direction 56 parallel to axis 27.

Figure 4C:
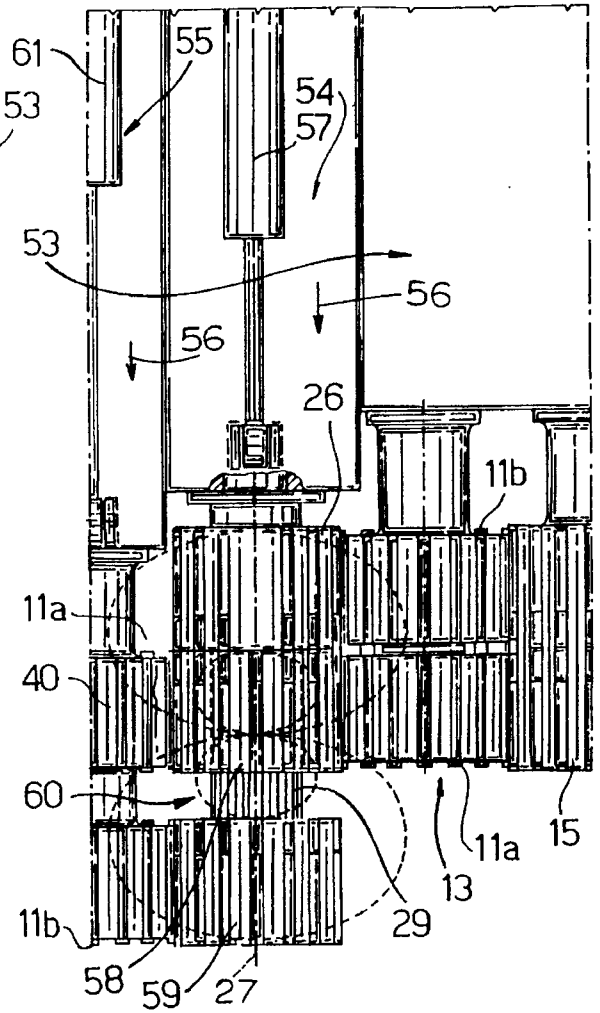
FIG. 4 shows a larger-scale plan view of a detail of the FIG. 3 machine in two operating positions and an intermediate transition position.
Figure 4B:
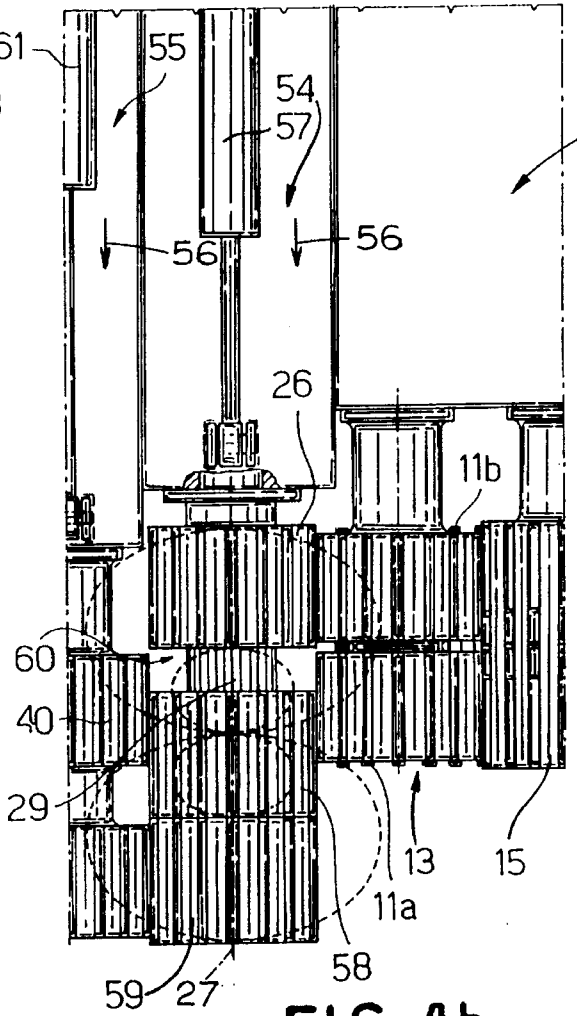

Again with reference to FIG. 3, fixed portion 53 directly supports rollers 13, 14, 15 and the whole (not shown) of machine 51 upstream from rollers 13, 14, 15; while portion 54 supports unit 24, and is connected to portion 53 via the interposition of a linear actuator 57 for moving portion 54, in direction 56, between a withdrawn position (FIG. 3) and an extracted position (FIGS. 4*b*, 4*c*).

Unit 24 of machine 51 is substantially the same as that of machine 2, except that, as opposed to roller 25, it comprises two coaxial rollers 58 and 59 coaxial with and the same size as roller 26. More specifically, rollers 26 and 59 are fitted in fixed manner to shaft 29; whereas roller 58, between rollers 26 and 59, is fitted in axially-sliding and angularly-fixed manner to an intermediate portion of shaft 29 by means of a splined coupling 60, so that it is movable, manually or by means of a known actuator (not shown), between a forward position (FIG. 4*a*) wherein roller 58 is adjacent to roller 59 with which it defines a double roller similar to roller 25, and a withdrawn position (FIG. 4*c*) wherein roller 58 is adjacent to roller 26 with which it defines a double roller also similar to roller 25. Roller 58 is locked selectively in the above two positions in known manner by means of lock pins (not shown).

Portion 55 supports rollers 40 and the whole of machine 51 downstream from rollers 40 in the traveling direction of the cigarettes, and is connected to portion 53 via the interposition of a linear actuator 61 for moving portion 55, in direction 56, between a withdrawn position (FIG. 3) and a forward position (FIGS. 4*b*, 4*c*).

Figure 4A:
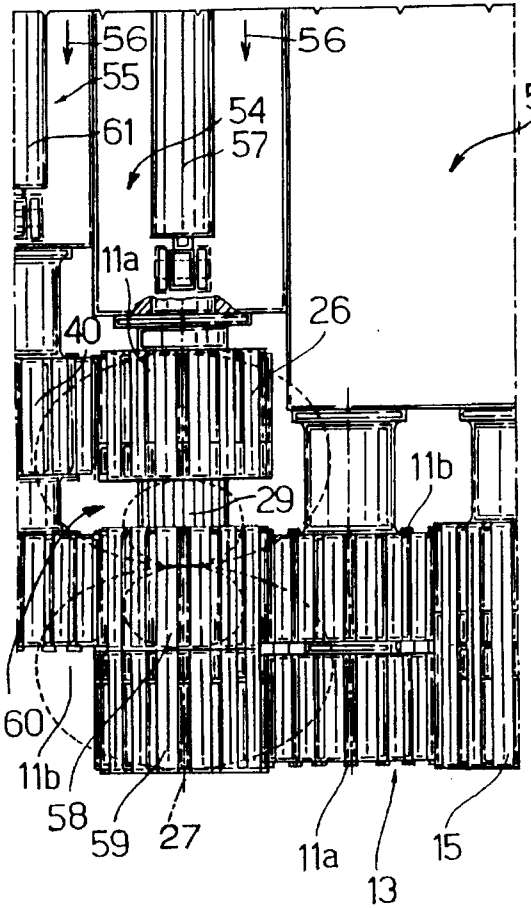

Machine 51 may thus assume two terminal operating configurations, a first as shown in FIGS. 3 and 4*a* and corresponding to the configuration of machine 2, and a second as shown in FIG. 4*c*.

With reference to FIG. 4, passage from the first to the second of the above configurations is effected (FIG. 4*b*) by operating actuator 57 to move portion 54 into the forward position so that roller 26 faces the portion of roller 13 engaged by cigarettes 11*b*; and by operating actuators 61 and 62 to move portion 55 into the forward position so that the outer track of roller 40 faces roller 59. At this point, roller 58 is released, is moved along shaft 29 (FIG. 4*c*) into contact with roller 26, and is then locked in position.

With machine 51 in the FIG. 4*c* configuration, therefore, the succession of cigarettes 11*a* fed by roller 13 onto roller 58 proceeds towards the output of the machine with the tobacco in view; and the succession of cigarettes 11*b* fed by roller 13 onto roller 26, and turned over by 180° by assembly 32 onto roller 59, is also fed to the output of the machine with the tobacco in view.

We claim:

1. A method of producing filter-tipped cigarettes (11), the method comprising stages consisting in feeding two side by side successions (21, 22) of oppositely-oriented filter-tipped cigarettes (11*a*, 11*b*); and in a turnover stage turning over the cigarettes (11*a*; 11*b*) in a first (21; 22) of the two successions (21, 22) so that they are oriented the same way as the cigarettes (11*b*; 11*a*) in a second (22; 21) of the two successions (21, 22); characterized in that said turnover stage provides for transferring each cigarette (11*a*; 11*b*) in a transfer stage in the first succession (21; 22) from a first position in relation to the cigarettes (11*b*; 11*a*) in the second succession (22; 21), to a second position on the opposite side of the cigarettes (11*b*; 11*a*) in the second succession (22; 21) as compared with the first position and a given distance from the cigarettes (11*b*; 11*a*) in the second succession (22; 21); said transfer stage involving turning each cigarette (11*a*; 11*b*) in the first succession (21; 22) over by 180°, to form two successions (21, 22) of equioriented, transversely-spaced cigarettes (11).

2. A method as claimed in claim 1, characterized in that said two successions (21, 22) of equioriented cigarettes (11*a*, 11*b*) are fed along respective separate paths (42, 41) to respective outputs (49) of said filter assembly machine (2).

3. A method as claimed in claim 1, characterized in that said two successions (21, 22) of equioriented cigarettes (11a, 11b) are fed along respective separate paths (42, 41) to respective outputs (49) of said filter assembly machine (2) for supply to respective transversely-spaced inputs (7, 6) of a two-input packing assembly (3).

4. A method as claimed in claim 1, characterized in that the cigarettes (11*a*; 11*b*) in said first succession (21; 22) are fed along a respective path (42) comprising a semi-annular portion along which said transfer and turnover stage is performed.

5. A method as claimed in claim 4, characterized in that the cigarettes (11*a*, 11*b*) in said two successions (21, 22) are fed to a first roller (25; 58, 59; 58, 26) coaxial with a second roller (25; 26; 59) located said given distance from the first roller (25; 58, 59; 58, 26); the first roller (25; 58, 59; 58, 26) being substantially twice as long as the second roller (25; 26; 59), and presenting seats (28) for each receiving two oppositely-oriented cigarettes (11) substantially contacting each other; said semi-annular portion of the path (42) of the cigarettes (11*a*,11*b*) in said first succession (21; 22) extending between a portion of a loading seat (28*a*) on the first roller (25; 58, 59; 58, 26) and an unloading seat (30*a*) on the second roller (25; 26; 59).

6. A method as claimed in claim 5, characterized in that said loading (28*a*) and unloading (30*a*) seats are coaxial; the cigarettes (11*a*; 11*b*) in said first succession (21; 22) being transferred from said loading seat (28*a*) to said unloading seat (30*a*) by means of two conical rollers (33; 34) tangent to each other, and tangent to the first roller (25; 58, 59; 58, 26) and the second roller (25; 26; 59) at said loading seat (28*a*) and said unloading seat (30*a*) respectively; said two conical rollers (33; 34) defining said semi-annular path portion.

7. A machine for producing filter-tipped cigarettes (11), the machine (2; 51) comprising first feeding means (13) for feeding two side by side successions (21, 22) of oppositely-oriented filter-tipped cigarettes (11*a*, 11*b*); turnover means (24) for turning over the cigarettes (11*a*; 11*b*) in a first (21; 22) of the two successions (21, 22) so that they are oriented the same way as the cigarettes (11*b*; 11*a*) in a second (22; 21) of the two successions; and second feeding means (40) for feeding said two successions (21, 22) of equioriented cigarettes (11*a*, 11*b*); characterized in that said turnover means (24) comprise transfer means (32) for transferring each cigarette (11*a*; 11*b*) in the first succession (21; 22), by turning it over by 180°, from a first position in relation to the cigarettes (11*b*; 11*a*) in the second succession (22; 21), to a second position on the opposite side of the cigarettes (11*b*; 11*a*) in the second succession (22; 21) as compared with the first position and a given distance from the cigarettes (11*b*; 11*a*) in the second succession (22; 21), to form two successions (21, 22) of equioriented, transversely-spaced cigarettes (11).

8. A machine as claimed in claim 7, characterized in that said turnover means (24) also comprise a first roller (25; 58, 59; 58, 26) and a second roller (25; 26; 59) with a common axis (27); the first roller (25; 58, 59; 58, 26) being substantially twice as long as the second roller (25; 26; 59), and presenting seats (28) for each receiving two oppositely-oriented cigarettes (11) substantially contacting each other; and the second roller (25; 26; 59) being located said given distance from the first roller (25; 58, 59; 58, 26), presenting seats (30) for each receiving a respective cigarette (11), and being connected to the first roller (25; 58, 59; 58, 26) by said transfer means (32).

9. A machine as claimed in claim 8, characterized in that said first (25; 58, 59; 58, 26) and second (25; 26; 59) rollers present one (25; 58, 59; 58, 26) a loading seat (28*a*), and the other (25; 26; 59) an unloading seat (30*a*) for the cigarettes (11*a*; 11*b*) in said first succession (21; 22); said transfer means (32) defining a semi-annular path portion extending between said loading (28*a*) and unloading (30*a*) seats.

10. A machine as claimed in claim 9, characterized in that said loading (28*a*) and unloading (30*a*) seats are coaxial; said transfer means (32) comprising two conical rollers (33; 34) rotating about respective axes (35; 37) coplanar with each other and with the common axis (27) of said first (25; 58, 59; 58, 26) and second (25; 26; 59) rollers; and said conical rollers (33; 34) being tangent to each other, and tangent to the first (25; 58, 59; 58, 26) and second (25; 26; 59) rollers at said loading seat (28*a*) and said unloading seat (30*a*) respectively.

11. A machine as claimed in claim 8, characterized in that said first (58, 59; 58, 26) and second (26; 59) rollers are defined by three constituent rollers (26, 58, 59) having a common axis (27) and angularly integral with one another; a first (58) of said three constituent rollers (26, 58, 59) being located between the other two, and being movable along said axis (27) between a first position adjacent to a second (26) of said three constituent rollers (26, 58, 59), and a second position adjacent to a third (59) of said three constituent rollers (26, 58, 59), to form, with the adjacent constituent roller (26; 59), said first roller (26, 58; 58, 59); and the remaining constituent roller (26; 59) forming said second roller (26; 59) which is located said given distance from the first roller (26, 58; 58, 59), receives a respective succession of cigarettes (11), and is connected to the first roller (26, 58; 58, 59) by said transfer means (32); first displacing means (54, 57) being provided for axially moving the three constituent rollers (26, 58, 59) so that said first roller (26, 58; 58, 59) is so positioned as to receive the two successions (21, 22) of oppositely-oriented, substantially mutually contacting cigarettes (11) from said first feeding means (13); and second displacing means (55, 61, 62) being provided for moving and so positioning said second feeding means (40) as to receive the two successions (21, 22) of cigarettes (11) from said first roller (26, 58; 58, 59) and said second roller (26; 59).

12. A method as claimed in claim 1, including selectively turning over by 180° the cigarettes (11*a*; 11*b*) in one (21) or other (22) of the two successions (21, 22); and transferring the overturned cigarettes (11*a*; 11*b*) onto the opposite side of and a given distance from the cigarettes (11*b*; 11*a*) in the other succession (22; 21), to form two successions (21, 22) of equioriented, transversely-spaced cigarettes, both in a so-called "visible filter" or "visible tobacco" position, depending on the succession selectively turned over.

13. A machine as claimed in claim 7, including displacing means (54, 57) for selectively setting the turnover means (24) to either one of two distinct operating positions, for turning over by 180° the cigarettes (11*a*; 11*b*) in one or other of the two successions (21, 22), and for transferring the overturned cigarettes (11*a*; 11*b*) onto the opposite side of and a given distance from the cigarettes (11*b*; 11*a*) in the other succession (22; 21), so as to supply said second feeding means (40) with two successions (21, 22) of equioriented, transversely-spaced cigarettes, both in a so-called "visible filter" or "visible tobacco" position, depending on the chosen operating setting of the turnover means (24).

* * * * *